United States Patent [19]

Schröter

[11] 4,395,256

[45] Jul. 26, 1983

[54] CENTRIFUGE ROTOR CLOSURE

[75] Inventor: Gerhard Schröter, Osterode, Fed. Rep. of Germany

[73] Assignee: Heraeus-Christ GmbH, Osterode, Fed. Rep. of Germany

[21] Appl. No.: 326,503

[22] Filed: Dec. 2, 1981

[30] Foreign Application Priority Data

Dec. 13, 1980 [DE] Fed. Rep. of Germany ..... 3047118

[51] Int. Cl.[3] ..... B04B 1/00

[52] U.S. Cl. ..... 494/38; 220/315

[58] Field of Search ..... 494/12, 38, 40; 220/315, 326, 319

[56] References Cited

U.S. PATENT DOCUMENTS 3,219,228 11/1965 Sorensen ..... 220/315
3,731,837 5/1973 Platts ..... 220/315
3,819,111 6/1974 Romanauskas et al. .
3,843,045 10/1974 Schmidt et al. .
3,998,383 12/1976 Romanauskas et al. .
4,015,775 4/1977 Rohde .
4,247,015 1/1981 Straub ..... 222/315

OTHER PUBLICATIONS

Laborpraxis, Fed. Rep. Germany, Sep. 1980, pp. 16–22, Hans Sternbach.

*Primary Examiner*—Robert W. Jenkins
*Attorney, Agent, or Firm*—Frishauf, Holtz, Goodman, Woodward

[57] ABSTRACT

To provide a vacuum-tight seal to the rotor of a gradient zone separation rotor, the rotor shaft (15) is formed with a circumferential groove (7) which can receive balls (6) located in radial grooves of a cover cap (2), and movable to engage positions with the circumferential groove (7) by an outer holding sleeve (3), or releasable engagement by pulling up on the sleeve (3) against spring pressure.

11 Claims, 2 Drawing Figures

CENTRIFUGE ROTOR CLOSURE

The present invention relates to centrifuges, and more particularly to bowl-type rotor centrifuges.

BACKGROUND

Various types of centrifuge systems and centrifuge apparatus are described in the publication "Labor-Praxis", September 1980, pp. 16–22. This publication, in FIG. 4 therefor, describes a bowl-type rotor which is subdivided into chambers by vanes or wings. U.S. Pat. No. 3,843,045, Oct. 22, 1974, Schmidt, illustrates the type of rotor with which the closure of the present invention can be used.

It has been found that various closure systems have sealing problems, particularly if the region surrounding the rotors—in this case the chamber of the rotor—must be evacuated, or is in a vacuum. U.S. Pat. No. 3,819,111, June 25, 1974, Romanauskas et al., describes and shows a specific type of rotor cover intended to overcome sealing difficulties.

THE INVENTION

It is an object to provide a cover for a rotor of the bowl type which provides increased reliability against leakage even under vacuum operation.

Briefly, the rotor has a closing cover for filling and removal of the substance to be centrifuged, and which was centrifuged, the closure stopper being fitted into a cap which includes a sleeve movable in axial direction, the sleeve retaining balls which can be fitted or engaged in recesses located on the circumference of a portion of the hub of the rotor.

DRAWINGS

Figure 1:
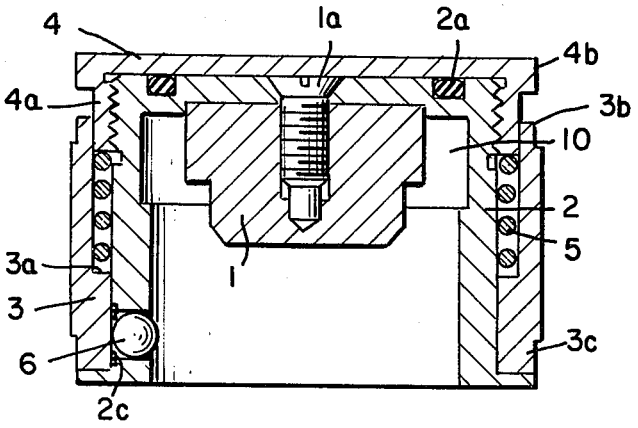
Figure 2:
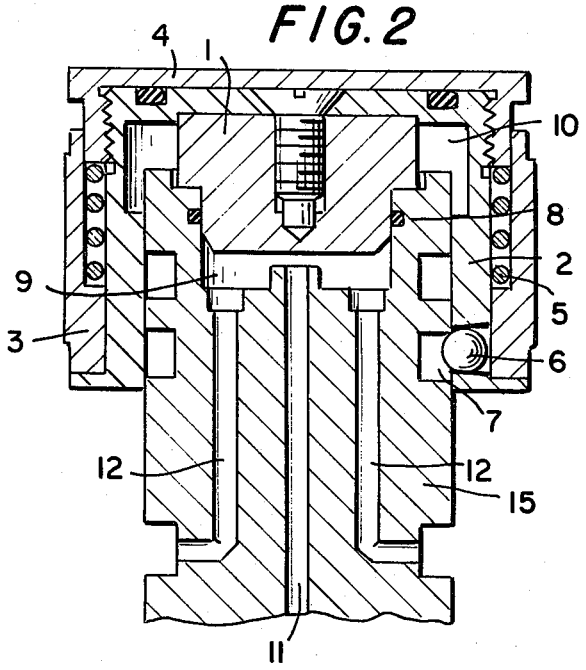

FIG. 1 is an axial section view of the cover in accordance with the present invention, removed from a rotor hub; and FIG. 2 illustrates the cover when assembled on a connecting stub of a bowl-type rotor.

The cover—see FIG. 1—includes a plug element 1, a cover cap 2, an outer sleeve 3, a rotor cover plate 4, at least one engagement ball 6, and a compression spring 5. The plug element 1 is secured to the cover cap 2 by a screw 1*a*. A sealing strip 2*a* is located in a circumferential ring-shaped groove in the upper side of the cap 2 to seal the cover plate 4 against the top surface of the cap 2. The cap 2 has a wider inner ring-shaped zone at the upper portion which is in alignment with the plug 1 to form a ring-shaped chamber 10 between the plug 1 and the cover cap 2.

The rotor has an axial stub or shaft 15 through which ducts 11 and 12 extend in axial direction to form filler and removal ducts. The ducts 12 terminate in a lateral groove; the construction of this portion of the rotor stub 12 can be in accordance with any well known and standard arrangement, see for example the referenced Schmidt et al U.S. Pat. No. 3,843,045. The stub 15 is additionally formed with recesses 7 at its outer circumference of such size and shape that they can accept the balls 6 therein. A plurality of balls are used, preferably three, uniformly distributed about the circumference of the stub 12 and, of course, of the cover cap 2. The balls are retained in the cover cap by suitable rolled or peened-over or deformed projections to prevent their escape from the positions in cross bores or the like formed in the cover cap 2 (FIG. 1). The balls 6 are radially movable within the cover cap 2, and can be pressed radially inwardly to fit into the recesses 7 of the stub 15.

The outer sleeve 3 surrounds a depending flange 4*a*, depending from the cover plate. The compression spring 5 is positioned between flange 4*a* and a shoulder 3*a* formed on the outer sleeve 3. The upper end of the rotor stub 15 is formed with an essentially cylindrical recess 9 at the upper end thereof, shaped to receive the plug 1. A circumferential groove is cut into the cylindrical wall defining the recess, in which a sealing ring 8 is located.

Operation: The rotor is filled, while standing still. After filling, the cover cap of FIG. 1 is applied to the rotor as follows: Sleeve 3 is raised until the projecting edge 4*b* of the cover plate is engaged by the upper edge 3*b* of the outer sleeve 3. This compresses the spring 5. The lower end portion 3*c* of outer sleeve 3 will be lifted out of covering engagement of the balls 6 and permits the balls 6 to move outwardly in radial bores 2*c*. The material of the cover cap 2 at the outer edges of the radial bores is deformed to prevent complete loss or release of the balls 6. With the sleeve 3 raised, the cap can be placed on the rotor, and the plug 1 will fit into the opening 9 of the rotor stub 15, and will be sealed by the sealing ring 8. Sealing 8 may, for example, be an O-ring.

Sleeve 3 can then be released, and pressure of the spring 5 will press it downwardly. This pushes the balls 6 inwardly. Balls 6 then can engage in the matching recess 7 in the outer circumference of the stub 15. Preferably, recess 7 is a ring groove so that the particular circumferential position of the cap of FIG. 1 on the stub 15 is not critical.

Upon evacuation of the rotor chamber, the cap cannot be pushed from the stub 15 of the rotor shaft by the pressure difference between the inside and outside of the rotor. The sealing ring 8 provides for sealing function.

Small quantities of liquid may escape upon rotation of the rotor. These liquids can collect in the space 10 beneath the upper portion of the cover cap 2, and radially adjacent the plug 1. They are isolated, however, from the rotor chamber, and thus do not cause interruptions or dips in vacuum.

The cover cap is particularly suitable with zone-type rotors used for reorientation, which are filled when stopped, and at that time are charged with samples. The separated centrifuged sample or test substance likewise is removed when the rotor is stopped.

The centrifuge may be used as an ultra high-speed centrifuge with a zone-type rotor and using specially shaped sample insert containers. The rotor is loaded with a liquid gradient, low-density first, through duct 11 and through the stub or shaft 15 to the bottom of the rotor chamber. The liquid gradient is then supplemented with liquid gradient of increasing density so that, with the rotor still stationary, a density gradient in vertical direction will result. Air displaced from the rotor can escape through the duct 12. After closing the rotor by the cap of FIG. 1, and evacuation of the rotor chamber, the centrifuge is started to rotate the rotor. Under influence of centrifugal force, the vertical density gradient is transferred into a radial gradient, including the test liquid which has been inserted into the liquid gradient. After suitable centrifuging time, the gradient is reoriented during braking of the rotor to stop condition. Upon removal of the cover cap, the gradient, with the test material therein, can be removed in well known and suitable manner, for example by a suitable pump coupled, for example, to an ultra-violet inspection monitor, a fractionating collection unit, or the like.

The cover cap provides tight sealing of the rotor chamber although the air pressure within the rotor may have the tendency to throw off the cover cap.

The entire rotor rotates within a vacuum chamber; the description has been limited to the shaft stub 15 and the cover cap, that is, the core of the rotor, not the entire centrifuge, or centrifuge structure, since the remainder of the centrifuge may be constructed in accordance with any well known and suitable arrangement, for example as described in the referenced publication, or the referenced U.S. Pat. No. 3,843,045, Schmidt et al.

I claim:

1. Centrifuge rotor closing structure having a rotor stub (15);

axially extending ducts (11, 12) passing through said rotor stub (15) and terminating at an end portion thereof;

and a cover cap closing off the end portion of said stub and inhibiting communication between the ends of said axially extending ducts and the ambient surrounding thereof, said closure comprising, in accordance with the invention, the combination of a plug element (1);

means (8, 9) sealingly fitting said plug element against the end portion of the stub (15);

a cover cap fitted over the plug element (1), said cover cap having a depending portion externally surrounding the stub (15);

radially movable rolling engagement elements (6) located in said depending portion of the plug;

an axially movable outer sleeve (3) surrounding said depending portion and, selectively, positioning said rolling elements in engagement with the stub (15) when moved to extend over the rolling elements, and releasing said rolling elements from engagement with the stub (15) when moved axially out of engagement with the rolling elements.

2. Closure according to claim 1, wherein said stub (15) is depressed in the region of the rolling elements (6) for positive engagement of said rolling elements when said axially movable outer sleeve (3) is moved to engage said elements and to thereby press them radially inwardly.

3. Closure according to claim 1, wherein said rolling elements are balls (6);

and said stub (15) is formed with a ring groove (7) receiving a portion of said balls for positive engagement of the cover cap (2) with the stub at the predetermined position of the ring groove on the stub, and the balls on the cover cap.

4. A density gradient zone separation ultra centrifuge having a rotor, said rotor comprising the centrifuge rotor closure claimed in claim 3.

5. Closure according to claim 1 or 3, further including a compression spring (5) in engagement with said sleeve and exerting axial force on said sleeve tending to move said sleeve axially in a position in engagement with said rolling engagement elements (6).

6. Closure according to claim 5, further including a cover plate (4) secured to said cover cap (2) and forming a counter element (**4*a*) for said spring (5**).

7. A density gradient zone separation ultra centrifuge having a rotor, said rotor comprising the centrifuge rotor closure claimed in claim 6.

8. A density gradient zone separation ultra centrifuge having a rotor, said rotor comprising the centrifuge rotor closure claimed in claim 5.

9. Closure according to claim 1, wherein said plug element (1) is of smaller outside diameter than the inside diameter of the depending portion of said cover cap (2) to form, therebetween, a ring space (10).

10. A density gradient zone separation ultra centrifuge having a rotor, said rotor comprising the centrifuge rotor closure claimed in claim 9.

11. A density gradient zone separation ultra centrifuge having a rotor, said rotor comprising the centrifuge rotor closure claimed in claim 1.

* * * * *